United States Patent [19]

Casutt

[11] 4,079,853

[45] Mar. 21, 1978

[54] TRAY

[76] Inventor: Toni Casutt, Kirchweg 46, 8102 Oberengstringen, Switzerland

[21] Appl. No.: 778,764

[22] Filed: Mar. 17, 1977

[30] Foreign Application Priority Data

Mar. 26, 1976 Switzerland ..... 3796/76

[51] Int. Cl.[2] ..... B65D 5/26

[52] U.S. Cl. ..... 229/35; 229/DIG. 8

[58] Field of Search ..... 229/30, 16 D, DIG. 3, 229/35, 2.5 R, 16 A, 16 C, DIG. 8; 206/44 K

[56] References Cited

U.S. PATENT DOCUMENTS

| | | | |
|---|---|---|---|
| 637,838 | 11/1899 | Vernon | 229/35 |
| 823,934 | 6/1906 | Davidson | 229/35 |
| 2,522,597 | 9/1950 | Blandford | 229/35 |
| 2,724,541 | 11/1955 | Metcalf | 229/30 |
| 3,038,634 | 6/1962 | Cheeley | 220/72 |

*Primary Examiner*—William T. Dixson, Jr.

*Assistant Examiner*—Allan N. Shoap

*Attorney, Agent, or Firm*—Flynn & Frishauf

[57] ABSTRACT

A flat blank of generally rectangular shape with rounded corners has a U-shaped incision in each end portion forming a tongue, extending endwise at each end from the portion that is to provide a tray bottom, that is separated by the incision from an end strip forming a continuous arch joining the portions that are to provide side walls for the tray. To set up the tray each end strip is folded inwards in the middle, the tongues are bent upwards and the most closely folded end strip mid-portion is pushed through a slot in the middle of the adjacent tongue, where it is held against flipping out by resilient flaps of the slot and by scollops or serrations on the upper edge of the folded-in strip bearing against the upper end of a slot. With different depths of insertion of the folded portion of the end strip through the tongue slot, different tray lengths can be provided with the same tray blank.

19 Claims, 9 Drawing Figures

Figure 1:
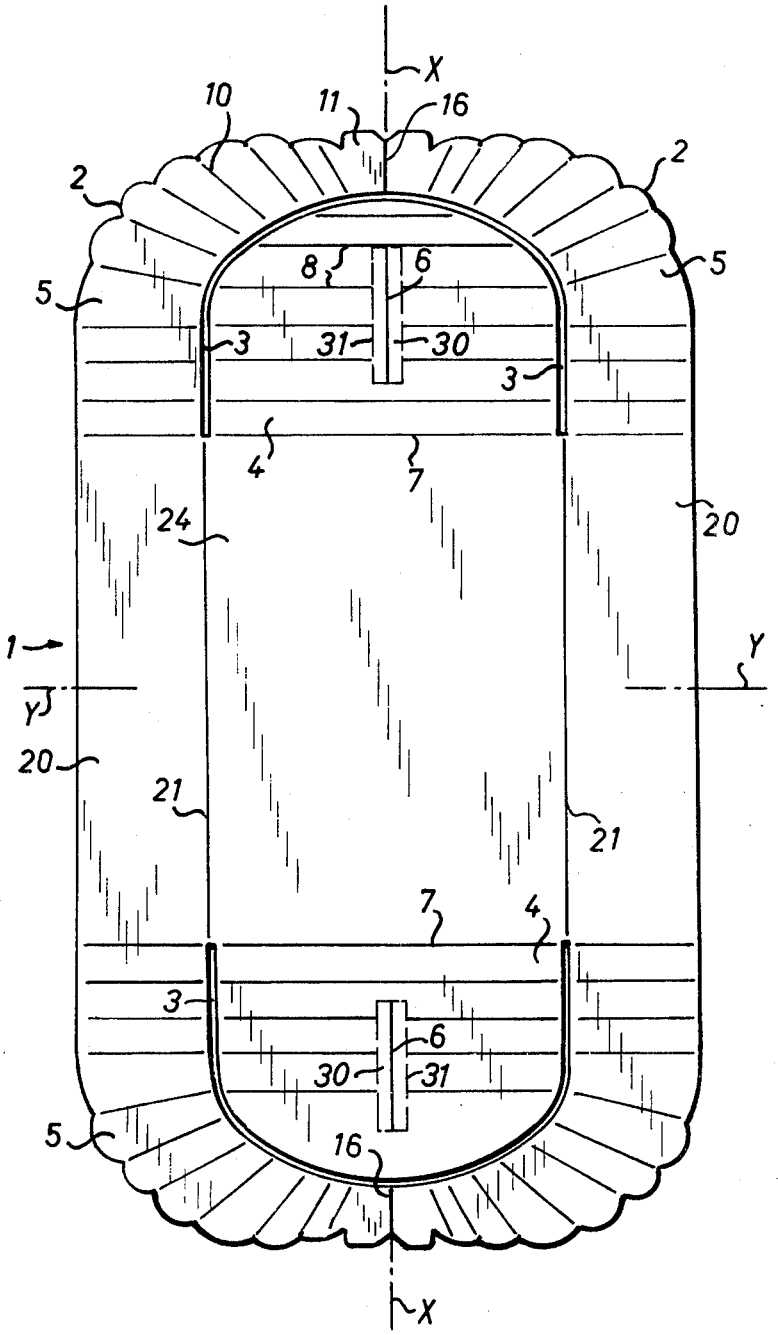

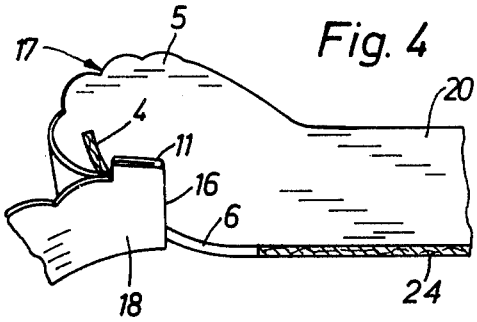
Fig. 4
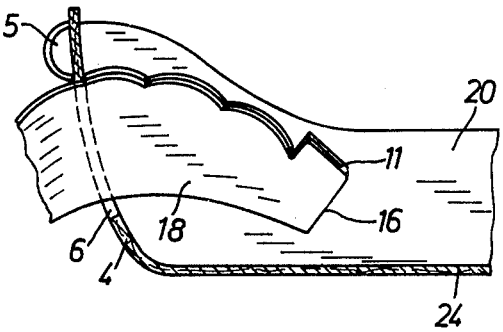
Fig. 5
Fig. 6
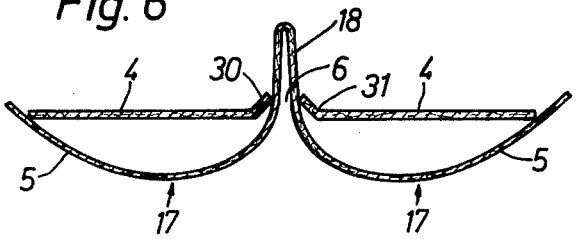

TRAY

This invention concerns a tray formed by set-up of a single cut-out piece of sheet material and a flat tray blank for setting up into such a tray, the tray being of a kind particularly useful for packing fruits and vegetables and being of a construction that makes possible adjustment of the length of the tray.

In the manufacture of packaging for articles for display and sale, particularly for the retail selling of fruits and vegetables in trays and transparent plastic sheet covering, the problem arises that a considerable number of different tray sizes is necessary according to the size and number of the fruits or vegetables to be included in a pack. The provision of different tray sizes complicates the storage of empty trays and makes the packing operation inconvenient.

It is an object of the present invention to provide a tray that can be set up from a flat blank that is variable in its size and hence in its volume capacity in order to fit the various dimensions of the goods to be contained, particularly in the case of fruits and vegetables.

SUMMARY OF THE INVENTION

An arch — shaped incision with the legs of the arch parallel to the longitudinal axis of the blank and pointing towards the middle thereof is provided in each end of the blank, the blank being generally of rectangular shape with rounded corners, so that an end strip is formed around the outside of each arch-shaped incision and the portion of the blank within the arch-shaped incision becomes a tongue extending end-wise from the central portion of the blank. The-arch shaped incision is of course symmetrical with respect to the longitudinal axis of the blank. The end strips are scored or grooved to facilitate their folding inward so as to form a double or re-entrant arch, when the tray is set up, and the tongues are bent upwards, and means are provided for engaging the folded or re-entrant portion of the end strips in the adjacent tongue to hold the tray in set up position.

A shoe-like tray can be provided with the rounded corners, arch-like incision, end strip, tongue and engaging means at only one end of the blank.

The engaging means are preferably a slot directed along the longitudinal axis of the blank in each tongue and preferably the slot is made by an I-shaped incision providing resilient lips along a central slit for pressing against the folded portion of the end strip inserted through the slot. Preferably the outer contour of the end strip at least on the end side of the blank is of scalloped or serrated form so as to provide scallops or serrations in the upper edge of the folded portion, when the tray is set up, that will catch in the upper end of the tongue slot. The end of the folded portion of the end strip, which is to say the outer edge of the center thereof as it lies in the flat blank, is preferably provided with a projection that will extend upwardly when the tray is set up, in order to act as a stop resting against the end of the tongue when the tray is extended to its maximum length.

Grooves to facilitate bending are provided in the tongues and end strips, those of the tongues being perpendicular to the longitudinal axis of the tray to allow bending up of the tongue corresponding to various desired tray lengths, and some grooves of the end strip, as they lie in the flat blank, being directed towards the middle of the slot in the adjacent tongue.

Additional bending grooves are provided joining the legs of the arched incisions and defining the sides of the bottom portion of the tray when it is set up and likewise defining the sidewalls which join the end strips. These lateral grooves may be a straight groove at each side of the bottom portion, or a groove that narrows the bottom portion towards the middle of the tray. In the latter case, another groove is provided between each of the aforesaid grooves and the side edges of the blank to facilitate bending up of the sidewalls.

The blank and tray of the invention have the advantage that the tongues can be bent up from the plane at the bottom at different transverse grooves, usually gradually, or over two or more grooves, thus varying the effective length and capacity of the inside of the tray to suit the particular collection of articles to be packed in it. Furthermore, the tray lends itself to being set up from the blank mechanically by a relatively simple means, which is a great convenience for a mass production article of this sort. It is also a further advantage that the blanks can be stored flat and occupy very little space. The manufacture of the blanks can be performed on rolls of sheet material in a procedure in which the waste, after stamping out the blanks, is very small because of the approximately rectangular shape of the blanks.

Figure 2:
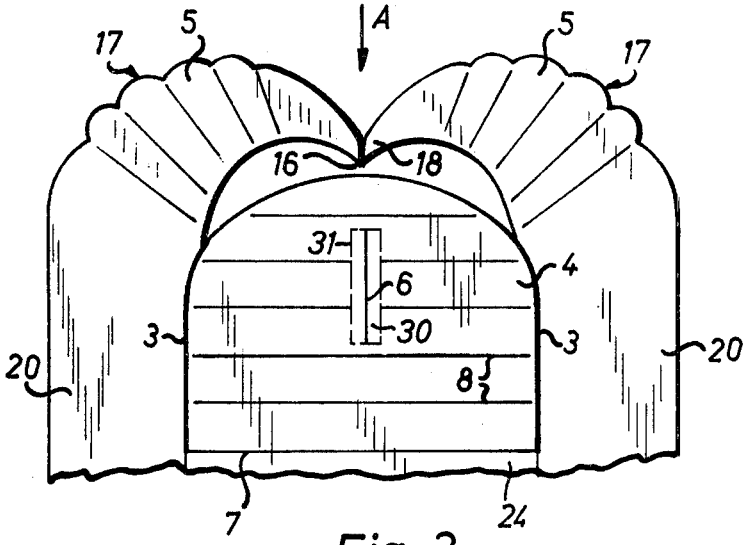
Figure 3:
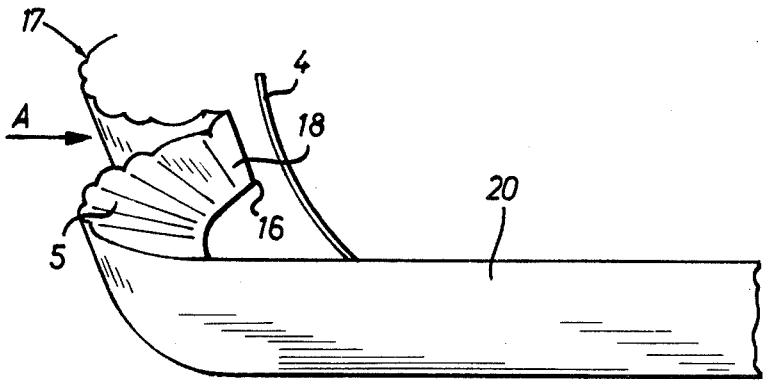
Figure 7:
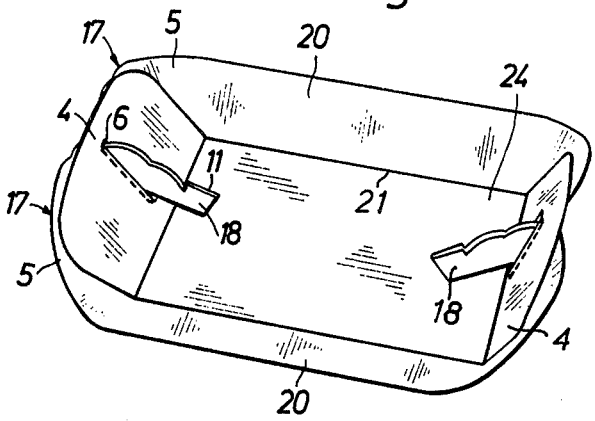
Figure 8:
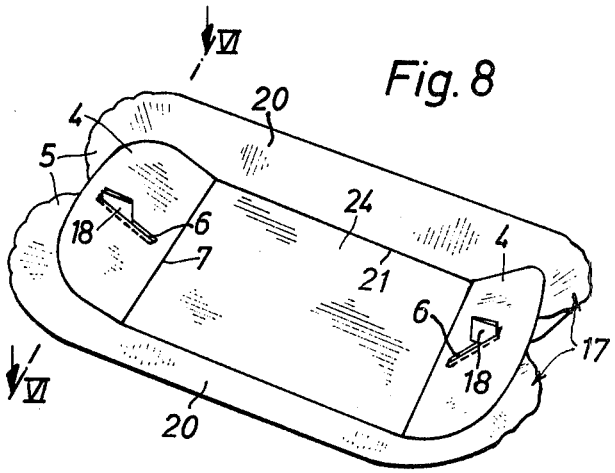
Figure 9:
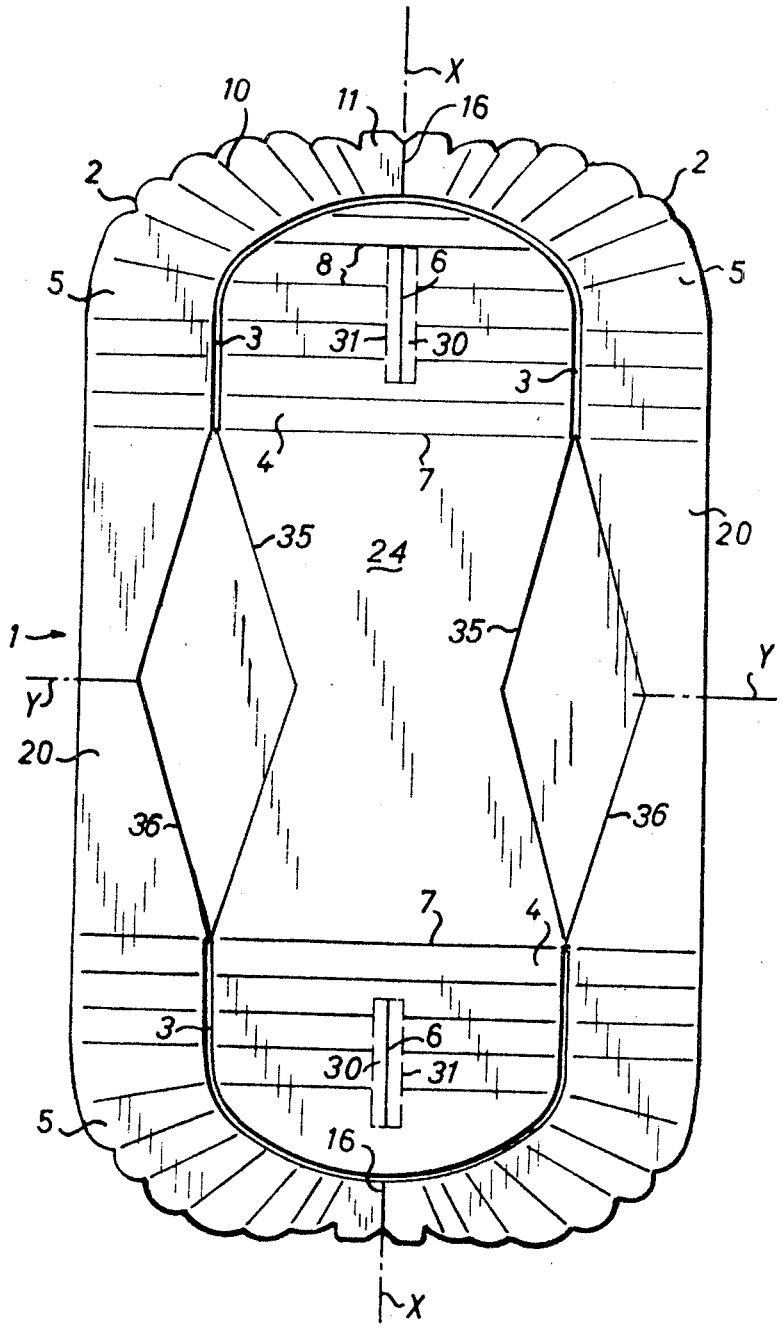

The invention is further described by way of example with reference to the accompanying drawings, in which:

FIG. 1. is a plan view of the flat blank according to the invention from which a tray may be set up;

FIG. 2. is a top view of the end portion of a blank according to the invention at a first stage of setting up the blank to form a tray;

FIG. 3. is an oblique side view somewhat from above, with the far side of the tray broken off, of the end portion of the blank in the process of being set up at the stage shown in FIG. 2;

FIG. 4. is a longitudinal section through the middle of the tongue of a tray set up for maximum length thereof;

FIG. 5. is a vertical section of the end portion of the tray through the middle of the tongue when the tray is set up for minimum tray length;

FIG. 6. is a horizontal section on the line VI—VI of FIG. 8;

FIG. 7. is a perspective view of one end of a tray according to the invention set up for minimum tray length;

FIG. 8. is a perspective view of a tray according to the invention as set up for maximum tray length; and FIG. 9. is a plan view of a modified form of tray blank in accordance with the invention.

The tray blank shown in FIG. 1 consists of a single piece of uniform material, preferably a relatively hard cardboard (sometimes referred to as half-cardboard) of a thickness of about 0.5 mm and can, if desired, be coated, lined with foil or otherwise or printed. The blank 1 has a shape that is roughly rectangular, elongated in the dimension of the median axis X. It is symmetrical in configuration relative to its length axis X and its cross axis Y. It has rather sharply rounded corners as shown at 2, the scalloped contour of which will be explained further below. An arched incision 3 through the material of the blank, essentially U-shaped, is provided in each of the end regions of the blank, the legs of the arch being parallel to and equally spaced from the axis X. This incision produces, at each end of the blank, a tongue for extending from the minimum bottom area 24 and also an end strip 5 going around the outside of the incision arch. The tongue 4 has a length that is about ⅔ of its width where it joins onto the bottom 24 along the line 7. Each of the tongues 4 has a slot 6 which is preferably provided by an I-shaped incision disposed substantially along the axis X and going right through the material, this shape of incision providing lips 30 on either side of the central slit. It is preferably located about in the middle of the tongue, extending preferably over about half of the length of the tongue. Grooves 8 which are parallel to each other and to the axis Y, (hence perpendicular to the axis X) are provided on the tongue to facilitate bending the tongue upwards in the setting up of a tray. These grooves may be scored or stamped on either or both sides of the blank, preferably being stamped on the side which is to be the top side of the tray.

The end strips 5 are connected to the portion of the blank that forms the sidewalls 20 of the tray and the width of the end strips 5 tapers down towards the mid portion, which is to say towards their intersection with the axis X.

At its narrowest location end strip is about half as wide as at its greatest width. Grooves 10 for facilitating the bending of the end strips are provided just as in the case of the tongues. Those that are farther from the axis Y than the middle of the slots 6 are directed so that they point approximately to the middle of the slot 6.

The rounding off of the corners of the blank, which is of course located on the contour of the end strips, has a radius that is about half of the width of the tongue 4. The end strip is continuous across the middle of the blank, which is to say in the region where the length axis X is located, and in the flat condition shown in FIG. 1, goes right around the whole length of the tongue 4. The end strips 5 are provided on their outer edges with scallops 28 or with serrations, or the like (not shown).

As shown more particularly in FIG. 6, two parallel lips 30 are provided in the slot 6 and can be bent inwardly of the tongue 4 along parallel bending grooves 31. In this case, the I-shaped incision is a simple sharp cut going through the material. The slot 6 can also be stamped out with an appropriate removal of material, such a stamped out incision being shown for the U-shaped cut between the outer edge of the tongue 4 and the end strip 5 at each end of the blank, (if slot 6 were not provided with the lips 30, it would have to be made wide enough to pass two thicknesses of the end strip 5 as will be presently evident).

In the configuration shown particularly in FIG. 6, the lips 30 have the advantage of yielding resiliently to open the slot when the folded portion 18 produced by folding an end strip 5 inwardly along the central line of the blank is inserted through the slot 6 as illustrated in FIGS. 4–8. When the folded portion 18 is thus inserted, the normal resilience of the material works against the pulling out of the folded portion 18 of the end strip by tending to close the slot 6.

It will now be described how a tray according to the invention can be set up from the blank shown in FIG. 1. Since both end portions of the blank are of the same configuration, only the conditions and situations relating to one end portion will be considered in detail. In the first stage of setting up, the end strip 5 is bent inwardly along a fold line 16 shown as a broken line in FIG. 1, although it may be marked by a groove similar to the bending grooves of 8 and 10 stamped into the blank. The fold line 16 coincides with the longitudinal axis of X. When thus folded inwardly, the end strip 5 has a V-shaped cusp that may be referred to as the folded portion 18, connected to a bent double arch 17 that may also be described as a re-entrant arch. At the same time that the end piece 5 is folded inward as just described, the tongue 4 is raised up, usually being bent up in a curve, beginning either at line 7 or at one of the grooves 8 between the line 7 and the middle of the slot 6, raising thereby the end of the tongue 4 well above the bottom level of the tray. The V-shaped folded portion 18 of the end strip is now pushed into the slot 6 of the tongue 4 in the direction of the arrow A shown in FIGS. 2 and 3 until it goes right through the tongue 4. During this movement of the end strip 5, the sidewalls 20 are bent up obliquely, this occurring along the grooves 21 at the sides of the bottom 24 of the tray.

The tray length can be varied for containing contents of different size, particularly in the case of fruits and vegetables individually in different size, as in the case of apples, pears, onions, fennel, etc., this being done by pushing the folded portion 18 of the end strip more or less deeply into the slot 6. In this way, there is varied on one hand the inclination of the tongue 4 and on the other hand the radius of the arches 17 of the strip 5 and their inclination relative to the bottom piece 24. The different insertion depths of the folded portion 18 changes the effective support length of the strip 5 on the tongue 4. FIG. 5 shows the insertive position of the folded portion 18 for the maximum tray length and FIG. 4 shows the corresponding insertion position of the folded portion 18 for the minimum tray length. In the latter case, the folded portion 18 is pushed as far as possible through the slot 6 of the tongue 4. Between these two extremes there are a number of possible intermediate possibilities, preferably five. The indexing in the intermediate position is provided by the scallops 28 or equivalent saw teeth (not shown) of the folded portion 18 that engage the upper limit of the slot 6, so that a catch holding it in a particular position is provided in each case.

Normally there are two rows of fruit or other more or less globular articles in the tray, so that the folded portion 18 projects into the open gap between the two rows. If, in a particular case the inward projection of the folded portion 18 into the interior of the tray should be troublesome, this projecting portion can be bent over against the tongue 4. In the most extended position of the tray, a stop is provided by an upwardly extending tab 11 at the end of the folded portion 18 to prevent an unintended release of the end strip, the tab 11 lying against the tongue 4 just above the upper end of the slot 6.

A packing tray in accordance with the present intention makes possible the variation of tray length over relatively wide ranges. In a practical manufactured embodiment in which the bottom portion 24 has a width of about 10 cm and a length of about 14 cm, the tray length measured across the bent pieces can be varied between 20 and 28 cm. Accordingly, the tray length can be fitted to the contents of different sizes or for different numbers of articles to be contained over quite wide ranges. If, for example, large apples are to be packed in the tray, a long tray length is chosen, whereas, if small apples are to be packed in it, a correspondingly shorter tray length is set. After the fruit is put in the tray, a thin transparent plastic sheet is stretched around the tray and its contents and secured any convenient way, for example, with an adhesive to tighten the plastic envelope or to fasten it to the bottom of the tray. A heat shrinkable plastic sheet can also be used which will be stretched tightly to envelope the contents upon warming. In these ways a unit convenient to handle ready for point of sale and easy to stack can be provided which is particularly well suited for self-service stores.

During the period between manufacture and utilization, the tray blanks can be stored as flat pieces that are very economical of storage and transportation space. In other words, the trays do not need to be set up until the contents are ready to be put in them. The blanks can be stamped out from a strip of cardboard as it is unrolled from a roll of the material, and this with very little waste material after stamping. Since each of the end strips 5, which in the flat blank lie just around the outside of the tongues 4, are a continuous strip, which is to say they are not cut at or near the longitudinal axis X, it is relatively simple and operationally reliable to set up a tray by mechanical machinery from the flat blank. For this purposes, for example, wedge-shaped mechanical fingers may grasp the two end portions of the blank at the fold line 16 of the strips 5 and then may be caused to move towards each other in the direction of the arrow A while the tray blank as a whole is held steady, as by clamping the bottom.

Modifications and variations of the blank and of the tray of the present invention are of course possible within the inventive concept. The provision of saw teeth rather than scallops has already been mentioned. It would also be possible to make the U-shaped incision 3 wavy to provide irregularities on the lower edges of the end strips when they are set up, although these would perhaps not be useful unless the tongue ends were bent over, perhaps by the plastic envelope already mentioned, so that the bottom edge of the slot 6 presses against the folded portion 18 of the end strip. The slot 6 does not need to be of uniform width and it may, for example, be triangular, with two sides forming a point towards the end of the tongue in which the folded portion 18 of the end strip will become wedged. With certain stiffnesses of material the slot 6 could extend to the end of the tongue, thus providing an engagement means into which the end strip could be slipped from the end of the tongue instead of pushed through as previously described, and grooves in the folded portion could be used to cooperate in such an engagement means.

Another modification mentioned here only by way of example is illustrated in FIG. 9, in which the bottom portion of the tray or tray blank is bounded laterally by grooves 35 in the shape of an obtuse V which reduce somewhat the width of the flat bottom portion of the tray towards the middle of the tray defined by the axis Y. In this case additional grooves 36 are provided in the sidewalls 20 to provide further bending in the sidewall portion of the tray. This modification gives the tray a gradually rounded transverse shape in its mid portion and at the ends.

I claim:

1. A tray formed by set-up of a single cut-out piece (1) of sheet material comprising:

a substantially rectangular bottom (24), having side and end boundaries defined by scored grooves (21, 35, 7) in said sheet material;

a bent-up tongue (4) extending outward and upward from at least one end boundary (7) of the bottom (24), having a round end contour, and joining integrally onto the remainder of the tray only where it joins said bottom along said end boundary (7);

sidewalls (20) extending upward and somewhat outward from the respective side boundaries of the bottom;

an end piece (5) in the general form of an arched strip joining integrally onto the adjacent ends of opposite sidewalls (20) at least one end of the tray, at which a tongue extends from the bottom as aforesaid, and folded inwardly substantially on the longitudinal axis of the tray so that the end piece (5) forms a double arch, and means (6) for adjustably engaging the folded portion (18) of said end piece (5) adjustably with the adjoining tongue so as to determine an adjustable length for the tray.

2. A tray as defined in claim 1 in which two said tongues and two said end strips are provided, in each case, one at each end of the tray, and in which said engaging means are likewise provided at each end of said tray.

3. A tray formed by set-up of a single cut-out piece (1) of sheet material comprising:

a substantially rectangular bottom (24), having side and end boundaries defined by grooves (21, 35, 7) in said sheet material;

a bent-up tongue (4) extending outward and upward from each of the end boundaries (7) of the bottom, having a round-end contour, and joining integrally onto the remainder of the tray only where it joins said bottom along said end boundary (7), and further having a slot (6) located and oriented substantially on the longitudinal axis (X) of the tray;

sidewalls (2) extending upward and somewhat outward from the respective side boundaries (21, 35) of the bottom (24), and end pieces (5) in the general form of an arched strip joining integrally onto adjacent ends of opposite sidewalls (20) at each end of the tray and each folded inward (16) substantially on the longitudinal axis of the of the tray with the folded portion (18) in each case being drawn inward through the slot (6) of the adjoining tongue (4) so that each end piece forms a double arch and is engaged in the tongue slot to hold the tray in its set-up condition.

4. A tray as defined in claim 3 in which the upper edge of each end piece is of scalloped or serrated contour (2) so as to catch in the upper end of the tongue slot and secure the tray in its set-up condition.

5. A tray as defined in claim 3 in which said tongues (4) and said end pieces (5) are provided with grooves (8, 10) for facilitating the bending of the material of said tongues and strips, said grooves (8) in said tongues (4) running perpendicularly to the longitudinal axis (X) of said tray and said grooves (10) in said end strips (5) running so that when the material of the tray is flattened, said end strip grooves (10) are directed approximately to the middle of the nearer of said tongue slots (6).

6. A tray as defined in claim 3 in which each of said end pieces (5) tapers down in width between both of its junctions with respective sidewalls (20) and the folded portion (18) of the end piece.

7. A tray as defined in claim 3 in which said folded portion (18) of each end piece has an upwardly directed projection (11) functioning as a stop and lying against the upper end of said slot (6) when the tray is extended to its maximum length, providing thereby security against the folded portion (18) slipping through said slot (6).

8. A tray as defined in claim 3 in which the width of each said tongue (4) is within the magnitude range of 2.5 to 3.5 times the greatest width of said end pieces (5).

9. A tray as defined in claim 3 in which each of said slots (6) in the respective tongues (4) is in the form of a I-shaped incision providing two parallel resilient lips (30) bordering a central slit.

10. A tray as defined in claim 3 in which the side boundaries of said bottom (24) taper down the width of the bottom to a minimum in the middle region of the tray and in which grooves are respectively provided in said sidewalls diverging from said side boundaries at their ends to a maximum separation therefrom near the middle of the tray which is not greater than the remaining width of the sidewall at that location.

11. A blank stamping of paperboard material for setting up to form a tray, in the form of a single piece of said material of generally rectangular form having rounded corners and further distinguished by having:

an arched incision through said material in each end portion, each arched incision having legs parallel to the longitudinal axis of the tray, being disposed symmetrically to the longitudinal axis of the tray, and having the crown of the arch towards the end of the tray but spaced therefrom to allow the end of the blank to provide a continuous arched end strip, the legs of the arch in each case terminating on a line perpendicular to the longitudinal axis of the tray;

a slot oriented substantially along the longitudinal axis of the blank in each of the portions of said blank respectively enclosed by said arched incisions; and a groove substantially along the axis of said blank across each of said end strips between the ends of the blank and the adjacent arched incision, for facilitating the inward folding of said end strip and thereby making possible the insertion of the respective folded portions of said end strips into the bottom side of the respective slot in the setting up of a tray.

12. A tray blank as defined in claim 11 in which the corners and end edges of said blank are of scalloped or serrated contour, whereby each of said continuous arched end strips have such contour for providing in cooperation with said slots a catch for holding a folded end strip when it is inserted into the corresponding slot for setting up a tray.

13. A tray blank as defined in claim 12 in which the mid portion of the end edges of said blank have an outwardly extending projection in the middle thereof, whereby an upwardly projecting portion is produced when the end strip is folded inward at the middle for insertion through one of said slots.

14. A tray blank as defined in claim 11 in which the portions of the blank respectively enclosed by said arched incisions are provided with bend-facilitating grooves running parallel to each other and perpendicular to the longitudinal axis of the blank and in which the end strips likewise provided with bend-facilitating grooves, of which those nearer the middle of the blank than the middle of the adjacent line of said slots are likewise parallel to each other and perpendicular to the longitudinal axis of the blank and those farther from the middle of the blank run in a direction approximately leading to the middle of the nearby one of said slots.

15. A tray blank as defined in claim 11 in which the width of said end strips tapers down towards the middle where it intersects the longitudinal axis of the blank.

16. A tray blank as defined in claim 11 in which the spacing between the legs of each arched incision is within the magnitude range of 2.5 to 3.5 times the greatest width of said end strips.

17. A tray blank as defined in claim 11 in which each of said slots is in the form of an I-shaped incision providing two parallel resilient lips (30) bordering a central slit.

18. A tray blank as defined in claim 11 in which bend-facilitating grooves parallel to the longitudinal axis of the blank are provided between the ends of the legs of one of said arched incisions and the ends of the legs of the other of said arched incisions.

19. A tray blank as defined in claim 11 in which between each end of a leg of one of said arched incisions and the end of the opposite leg of the other of said arched incisions there is provided a bend-facilitating groove in the shape of an obtuse V with its apex towards the middle of the tray and a second groove in the shape of an obtuse V with its apex towards the side edge of the blank.

* * * * *